United States Patent [19]

Torisawa

[11] Patent Number: 4,913,568

[45] Date of Patent: Apr. 3, 1990

[54] DOT PRINTER

[75] Inventor: Yoshihiro Torisawa, Shizuoka, Japan

[73] Assignee: Tokyo Electric Co., Ltd., Tokyo, Japan

[21] Appl. No.: 245,324

[22] Filed: Sep. 16, 1988

Related U.S. Application Data

[63] Continuation of Ser. No. 580,808, Feb. 16, 1984, abandoned.

[30] Foreign Application Priority Data

Feb. 24, 1983 [JP] Japan ..... 58-29681
Feb. 24, 1983 [JP] Japan ..... 58-29863

[51] Int. Cl.[4] ..... B41J 3/10

[52] U.S. Cl. ..... 400/124; 400/174; 101/93.05; 346/140 R

[58] Field of Search ..... 101/93.05, DIG. 13; 400/118, 119, 121, 124, 174, 124 IW; 346/140 A, 140 R

[56] References Cited

FOREIGN PATENT DOCUMENTS 164174 12/1980 Japan ..... 400/124
12688 1/1982 Japan ..... 400/124
188380 11/1982 Japan ..... 400/124
188385 11/1982 Japan ..... 400/124
189862 11/1982 Japan ..... 400/124

*Primary Examiner*—William Pieprz
*Assistant Examiner*—James R. McDaniel
*Attorney, Agent, or Firm*—Oblon, Spivak, McClelland, Maier & Neustadt

[57] ABSTRACT

A dot printer wherein a film of magnetic ink is formed in a slit shaped between a pair of magnetic poles, and needles piercing through the ink film thus formed are driven to deposit the magnetic ink on a recording paper so as to print dots thereon. The tips of the needles in an undriven state are positioned in the ink film proximately to one surface thereof adjacent to the recording paper, so that an adequate amount of the magnetic ink is deposited on the paper to eventually attain clear printing.

5 Claims, 4 Drawing Sheets

DOT PRINTER

This is a continuation, of application Ser. No. 06/580,808, filed Feb. 16, 1984.

FIELD OF THE INVENTION

The present invention relates to dot printer and, more particularly, to a type which forms dots on a recording paper by furnishing the tips of a multiplicity of needles with ink and then driving the needles selectively to transfer the ink onto the recording paper, thereby printing a character, figure, pattern or the like on the paper with an aggregation of such dots.

OBJECTS OF THE INVENTION

It is a first object of the present invention to achieve a clear printed state by rendering optimal the amount of magnetic ink which is to be deposited on a recording paper.

A second object of the invention resides in reducing the diameter of each dot printed.

A third object of the invention is to prevent unnecessary evaporation of magnetic ink.

A fourth object of the invention resides in forming a thin film of magnetic ink.

Other objects and advantages of the invention will become apparent from the following description.

DESCRIPTION OF THE PRIOR ART

Figure 1:
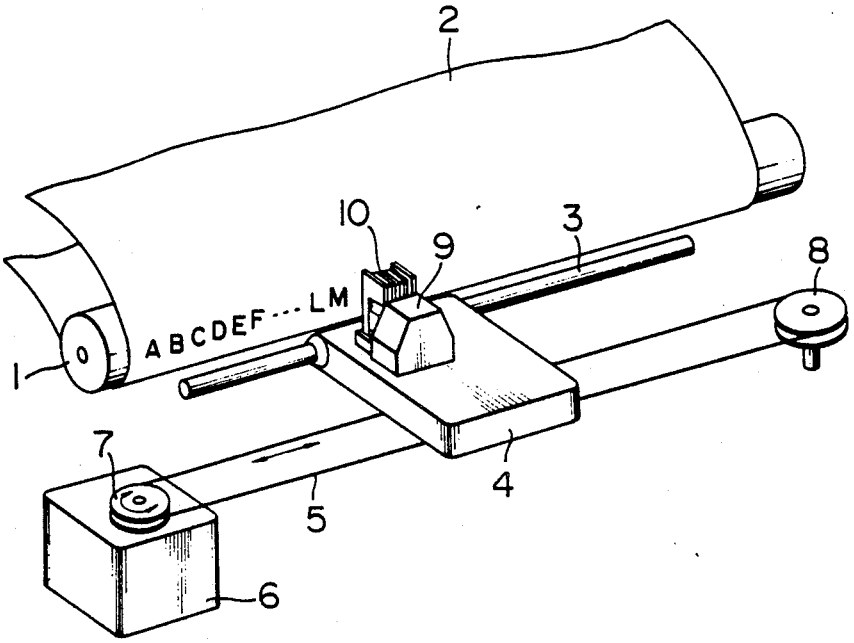
FIG. 1 is a perspective view of an exemplary embodiment of the present invention.

Of the conventional dot printers, there are generally known a wire dot printer and a thermal printer. In the former type that selectively drives needles for printing, the needles are actuated to impact either directly against a pressure sensitive paper or through a print ribbon against a recording paper. Consequently, a disadvantage is unavoidable with respect to a considerable noise emitted during the printing operation.

In order to eliminate such a disadvantage, there has been proposed an improvement as disclosed in Italian Patent Application (IT) [31] 68834-A/79, published on Sept. 19, 1979. This published application discloses a dot printer wherein a printing operation is performed by first feeding ink to the tips of needles and then bringing the tips into contact with a recording paper. In such a type, however, there exist some problems including that the ink scatters at the moment of contact, and the area of each dot becomes comparatively larger than that of the needle tip, hence rendering the print indistinct. Such troubles are derived from an excessive amount of the ink carried by the needles.

DESCRIPTION OF THE PREFERRED EMBODIMENT

A printing paper (2) serving as a recording member is wound around a platen (1) which confronts a carriage (4) reciprocated along a guide shaft (3) disposed in parallel with the platen (1). A driving wire (5) is connected to the carriage (4) and is wound around both a driving pulley (7) for a carriage motor (6) and a driven pulley (8) spaced apart from the driving pulley (7).

Figure 2:
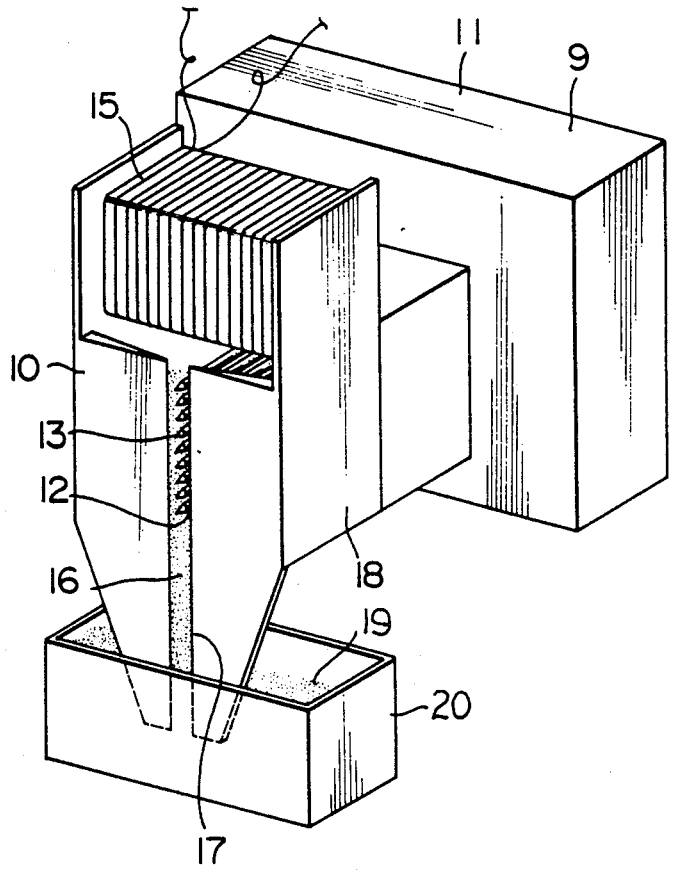
FIG. 2 is a perspective view of principal components in the embodiment of FIG. 1.
Figure 3:
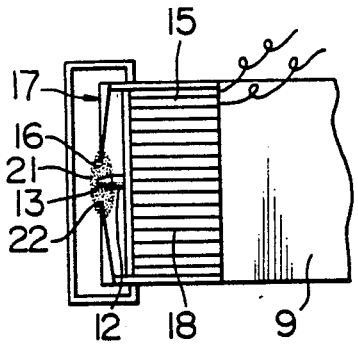
FIG. 3 is a plan view of the principal components shown in FIG. 2.
Figure 4:
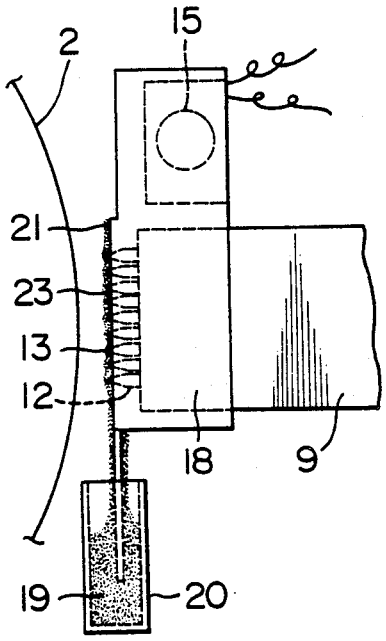
FIG. 4 is a side view of the principal components shown in FIG. 2.
Figure 5:
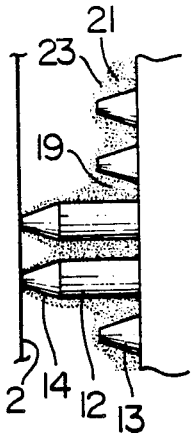
FIG. 5 is an enlarged partial side view of the components in FIG. 4.
Figure 7:
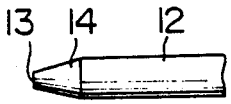
FIG. 7 is a side view of a needle.
Figure 8:
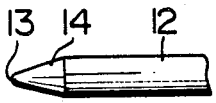
FIG. 8 is a side view of a modified exemplary needle.

The carriage (4) is equipped with a needle head (9) and an ink-film forming unit (10). As shown in FIG. 2, the head (9) has a driving section (11) where a plurality of needle magnets (not shown) are arrayed. A plurality of needles (12) actuatable by the driving section (11) are so disposed that the tips (13) thereof are aligned vertically in a row. Each needle (12) has a distal end ending in a tip (13) and a proximal end operatively associated with a corresponding needle magnet (not shown). As shown in FIGS. 5, 7 and 8, each of the needle tips (13) is shaped to be gradually thinner to form a tapered portion (14). The needles (12) are composed of stainless steel and are arrayed at a pitch of 0.36 mm, each having a diameter of 0.2 mm with its tip tapered to a diameter of 0.15 mm.

The aforesaid ink-film forming unit (10) has, in its upper portion, an electromagnetic coil (15) to constitute an electromagnet. The two terminals of the coil (15) are coupled to side walls (18) integral with magnetic pole plates (17) which are triangular in cross-section and opposed to each other to form a slit (16) therebetween. The pole plates (17) extend downward and project at the fore ends thereof into an ink vessel (20) where magnetic ink (19) is stored. A voltage of 0.7 to 1.0 volt is applied to the electromagnetic coil (18) to produce an output of 150 ampereturn. The magnetic ink (19) has a magnetic induction of 200 gauss and a viscosity of 20 cp or less. The ink vessel (20) is so located that, upon energization of the electromagnetic coil (15), a magnetic ink film (21) is formed over the entirety of the slit (16).

Figure 6:
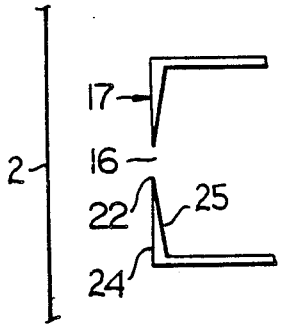
FIG. 6 is a plan view of magnetic poles.

The edges (22) of the magnetic pole plates (17) to form the ink film (21) are shaped to be thin so as to increase the flux density in the slit (16) as well as to render the ink film (21) thin. That is, and is best seen in FIG. 6, each one of the magnetic pole plates (17) has a first surface (24) which during use of the dot printer, is adjacent to the printing paper (2), faces the printing paper (2), and is at least approximately parallel to the printing paper (2) and a second surface (25) which, during use of the dot printer, faces away from the printing paper (2) and slopes so that each one of the magnetic pole plates (17) has a minimum thickness adjacent to the slit (16) and a maximum thickness at a point remote from the slit (16).

The respective tips (13) of the needles (12) are placed in the magnetic ink film (21) thus formed. The tips (13) are so positioned as to be proximate to one surface of the ink film (21) adjacent to the recording paper (2).

In the structure mentioned above, when any of the needles (12) is selectively driven in response to a print command, the magnetic ink (19) adhering to the needle tip (13) is transferred onto the recording paper (2) to form a dot thereon. At this moment, since the tip (13) of each needle (12) in an undriven state is positioned proximate to the surface (23) of the ink film (21) as illustrated in FIG. 5, there exists merely a small amount of the ink at the needle tip (13) opposed to the recording paper (2), whereby the amount of the ink transferred onto the paper (2) is reduced. Therefore, the ink (19) scattering at the time of driving the needle (12) is also reduced in amount. The tip (13) of each needle (12) may be shaped into a circular arc as illustrated in FIG. 8.

Figure 9:
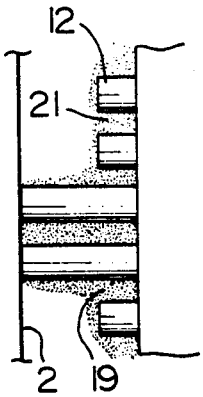
FIG. 9 is a side view illustrating a state of operation performed with needles having non-tapered tips.

Since the tip (13) of each needle (12) has a tapered portion (14), even when the two adjacent needles (12) are driven simultaneously, there never occurs an undesired phenomenon that the magnetic ink (19) existing therebetween is deposited on the recording paper (2). In an example illustrated in FIG. 9 for comparison, a tapered portion (14) is not formed at the tip of any of the needles (12). In such a structure, the magnetic ink (19) between the two adjacent needles (12) is transferred with the motion of each needle and is thereby deposited on the paper (2). Consequently, the amount of the transferred ink becomes greater than that in the present invention, so that the dot is rendered larger at the circumference thereof to fail in attaining clear printing as a result.

The electromagnetic coil (15) is kept deenergized during no use of the printer, whereby the magnetic ink (19) in the slit (16) is returned into the ink vessel (20). Thus, it becomes possible to prevent a faulty operation that may otherwise be induced by a residual of the evaporated magnetic ink (19) adhering to the slit (16) or the needles (12).

What is claimed is:

1. A dot printer comprising:

(a) a source of magnetic ink;

(b) a pair of magnetic pole plates forming a slit therebetween which, during use of the dot printer, is located adjacent to a recording medium, each one of said pair of magnetic pole plates being triangular in cross-section and having:

(i) a first flat surface which, during use of the dot printer, is adjacent to the recording medium, faces the recording medium, and is at least approximately parallel to the recording medium and (ii) a second flat surface which, during use of the dot printer, faces away from the recording medium and slopes so that each one of said pair of magnetic pole plates has an essentially linear edge adjacent said slit and a maximum thickness at a point remote from said slit;

(c) first means for generating a magnetic flux between said pair of magnetic pole plates so as to feed magnetic ink from said source of magnetic ink into said slit in a film which, during use of the dot printer, is located adjacent to the recording medium and has two spaced surfaces, a first one of said two spaced surfaces of the film of magnetic ink being adjacent to the surface of the recording medium to be printed and a second one of said two spaced surfaces of the film of magnetic ink being farther away from the surface of the recording medium to be printed than the first one of said two spaced surfaces;

(d) a plurality of printing needles each one of which has a distal end and a proximal end, each one of said plurality of printing needles being disposed so as to be at least approximately perpendicular to said two spaced surfaces of the film of magnetic ink; and (e) second means for selectively moving each one of said plurality of printing needles back and forth between an inoperative position in which the distal end of the needle is located proximate to the first one of said two spaced surfaces of the film of magnetic ink and an operative position in which the distal end of the needle effects printing.

2. A dot printer as recited in claim 1 wherein said first means comprises an electromagnet.

3. A dot printer as recited in claim 1 wherein:

(a) said source of magnetic ink is an ink vessel and (b) portions of said pair of magnetic pole plates are positioned so as to be immersed in said ink vessel during use of the dot printer.

4. A dot printer as recited in claim 1 wherein, when said plurality of printing needles are in their inoperative positions, their distal ends project beyond said first surface of said magnetic pole plates.

5. A dot printer as recited in claim 1 wherein the distal end of each of said plurality of printing needles is shaped into a circular arc.

* * * * *